US009266221B2

(12) United States Patent
Hsu et al.

(10) Patent No.: US 9,266,221 B2
(45) Date of Patent: Feb. 23, 2016

(54) NONWOVEN COMPOSITE ABRASIVE COMPRISING DIAMOND ABRASIVE PARTICLES

(75) Inventors: Shyiguei Hsu, McAllen, TX (US); Alejandro Gomez, Tamaulipas (MX); Fabio de A. Pinto, Albany, NY (US); John E. Stockton, McAllen, TX (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 776 days.

(21) Appl. No.: 13/267,465

(22) Filed: Oct. 6, 2011

(65) Prior Publication Data

US 2012/0088443 A1 Apr. 12, 2012

Related U.S. Application Data

(60) Provisional application No. 61/390,249, filed on Oct. 6, 2010.

(51) Int. Cl.
*B24D 11/00* (2006.01)
*B24D 18/00* (2006.01)
(Continued)

(52) U.S. Cl.
CPC . *B24D 3/28* (2013.01); *B24B 37/24* (2013.01); *B24D 11/02* (2013.01); *B24D 18/00* (2013.01)

(58) Field of Classification Search
CPC ..... B24B 37/24; B24D 11/00; B24D 11/001; B24D 11/008; B24D 3/00; B24D 3/002; B24D 3/007; B24D 3/02; B24D 3/28; B24D 3/32; B24D 18/00; B24D 18/0027; B24D 18/0072
USPC ..... 51/295, 297, 298, 300; 451/526, 530, 451/532, 533, 536, 537
See application file for complete search history.

(56) References Cited

U.S. PATENT DOCUMENTS 4,078,340 A 3/1978 Klecker et al.
5,002,828 A 3/1991 Cerceau
(Continued)

FOREIGN PATENT DOCUMENTS

JP 2003-321819 A 11/2003
JP 2004-291109 A 10/2004
(Continued)

OTHER PUBLICATIONS

"High Velocity Oxygen Fuel Thermal Spray Process", HVOF, Schematic Diagram of the HVOF Process, 3 pages, Accessed May 20, 2010. <http://www.gordonengland.co.uk/hvof.htm>.
(Continued)

*Primary Examiner* — Eileen Morgan
(74) *Attorney, Agent, or Firm* — Joseph P. Sullivan; Abel Law Group, LLP

(57) ABSTRACT

An abrasive article includes a support, a first polymeric binder, a second polymeric binder, and abrasive particles. The support includes a plurality of nonwoven layers. A method of forming an abrasive article includes providing a support including, applying a first coating of the first polymeric binder to the support, applying superabrasive particles to the coated support, applying a layer of a second polymeric binder overlying the superabrasive particles. The method further includes compressing the support and applying heat to cure the first polymeric binder. A method of preparing a work piece includes applying a thermal spray coating to the work piece, and polishing the thermal spray coating with the abrasive article.

15 Claims, 3 Drawing Sheets

(51) Int. Cl.

| | |
|---|---|
| ***B24D 3/28*** | (2006.01) |
| ***B24B 37/24*** | (2012.01) |
| ***B24D 11/02*** | (2006.01) |

(56) References Cited

U.S. PATENT DOCUMENTS

| | | | | |
|---|---|---|---|---|
| 5,346,516 | A | 9/1994 | Alkhas et al. | |
| 5,924,917 | A * | 7/1999 | Benedict et al. | 451/526 |
| 5,975,988 | A | 11/1999 | Christianson | |
| 6,352,567 | B1 | 3/2002 | Windisch et al. | |
| 6,406,577 | B1 * | 6/2002 | Benedict et al. | 156/137 |
| 6,713,156 | B1 * | 3/2004 | Pauls et al. | 428/141 |
| 7,189,784 | B2 * | 3/2007 | Barber, Jr. | 525/124 |
| 7,393,371 | B2 | 7/2008 | O'Gary et al. | |
| 7,628,829 | B2 * | 12/2009 | Woo et al. | 51/295 |
| 7,985,269 | B2 * | 7/2011 | Ludwig | 51/298 |
| 8,066,786 | B2 | 11/2011 | Keipert et al. | |
| 2003/0114078 | A1 * | 6/2003 | Mann | 451/28 |
| 2004/0098923 | A1 * | 5/2004 | Hood et al. | 51/296 |
| 2004/0101680 | A1 * | 5/2004 | Barber, Jr. | 428/360 |
| 2005/0282480 | A1 | 12/2005 | Nelson et al. | |
| 2006/0041065 | A1 * | 2/2006 | Barber, Jr. | 525/124 |
| 2007/0128989 | A1 | 6/2007 | Jentgens et al. | |
| 2007/0298697 | A1 * | 12/2007 | Charmoille et al. | 451/425 |
| 2008/0127572 | A1 * | 6/2008 | Ludwig | 51/297 |
| 2008/0216414 | A1 | 9/2008 | Braunschweig et al. | |
| 2008/0229672 | A1 * | 9/2008 | Woo et al. | 51/295 |
| 2008/0233850 | A1 * | 9/2008 | Woo et al. | 451/526 |
| 2010/0092746 | A1 | 4/2010 | Coant et al. | |
| 2012/0167478 | A1 * | 7/2012 | Herbert | 51/295 |

FOREIGN PATENT DOCUMENTS

| | | | |
|---|---|---|---|
| JP | 2007-290061 | A | 11/2007 |
| JP | 2010-058187 | A | 3/2010 |
| JP | 2010-513049 | A | 4/2010 |

OTHER PUBLICATIONS

PCT/US2011/055120 International Search Reports mailed Mar. 19, 2012, 1 page.

* cited by examiner

NONWOVEN COMPOSITE ABRASIVE COMPRISING DIAMOND ABRASIVE PARTICLES

CROSS-REFERENCE TO RELATED APPLICATION(S)

The present application claims priority from U.S. Provisional Patent Application No. 61/390,249, filed Oct. 6, 2010, entitled "NONWOVEN COMPOSITE ABRASIVE COMPRISING DIAMOND ABRASIVE PARTICLES," naming inventors Shyiguei Hsu, Alejandro Gomez, Fabio Pinto, and John E. Stockton, which application is incorporated by reference herein in its entirety.

FIELD OF THE DISCLOSURE

This disclosure, in general, relates to a nonwoven composite abrasive comprising diamond abrasive particles.

BACKGROUND

Abrasive articles, such as coated abrasives and bonded abrasives, are used in various industries to machine work pieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniformly smooth surface. Additionally, abrasive articles are used to polish articles after applying a thermal spray coating. In some cases, the articles can have complex shapes and conventional abrasives do not have the right balance of strength, flexibility, and grind to provide a satisfactory finish. As such, an improved abrasive product would be desirable.

SUMMARY

In a particular embodiment, an abrasive article includes a support including a plurality of nonwoven layers, abrasive particles having a Mohs hardness of at least about 8.0, a first polymeric binder located between the support and the abrasive particles, and a second polymeric binder disposed over the abrasive particles and the first polymeric binder.

In an embodiment, an abrasive article can include a support, a first polymeric binder, a second polymeric binder, and abrasive particles. The support can include a plurality of nonwoven layers. In a particular embodiment, the support can include about 2 to about 50 nonwoven layers and each nonwoven layer can include a plurality of fibers bonded together by a third polymeric binder. In another particular embodiment, the abrasive article can be in the form of a wheel and can have an open structure.

In another embodiment, a method of forming an abrasive article can include providing a support including a plurality of nonwoven layers, applying a first coating of the first polymeric binder to the support, applying abrasive particles to the coated support, and applying a layer of the second polymeric binder overlying the abrasive particles. The method can further include compressing the support and applying heat to cure the polymeric binders.

In yet another embodiment, a method of preparing a work piece can include applying a thermal spray coating to the work piece, and polishing the thermal spray coating with an abrasive wheel. The abrasive wheel can include a support including a plurality of nonwoven layers, a first polymeric binder, a second polymeric binder, and superabrasive particles.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In an embodiment, an abrasive article can include a support, a first polymeric binder, a second polymeric binder, and abrasive particles. The support can include a plurality of nonwoven layers. The abrasive particles can have a Mohs hardness of at least about 8.0. Additionally, the abrasive article can have an open structure.

Figure 1:
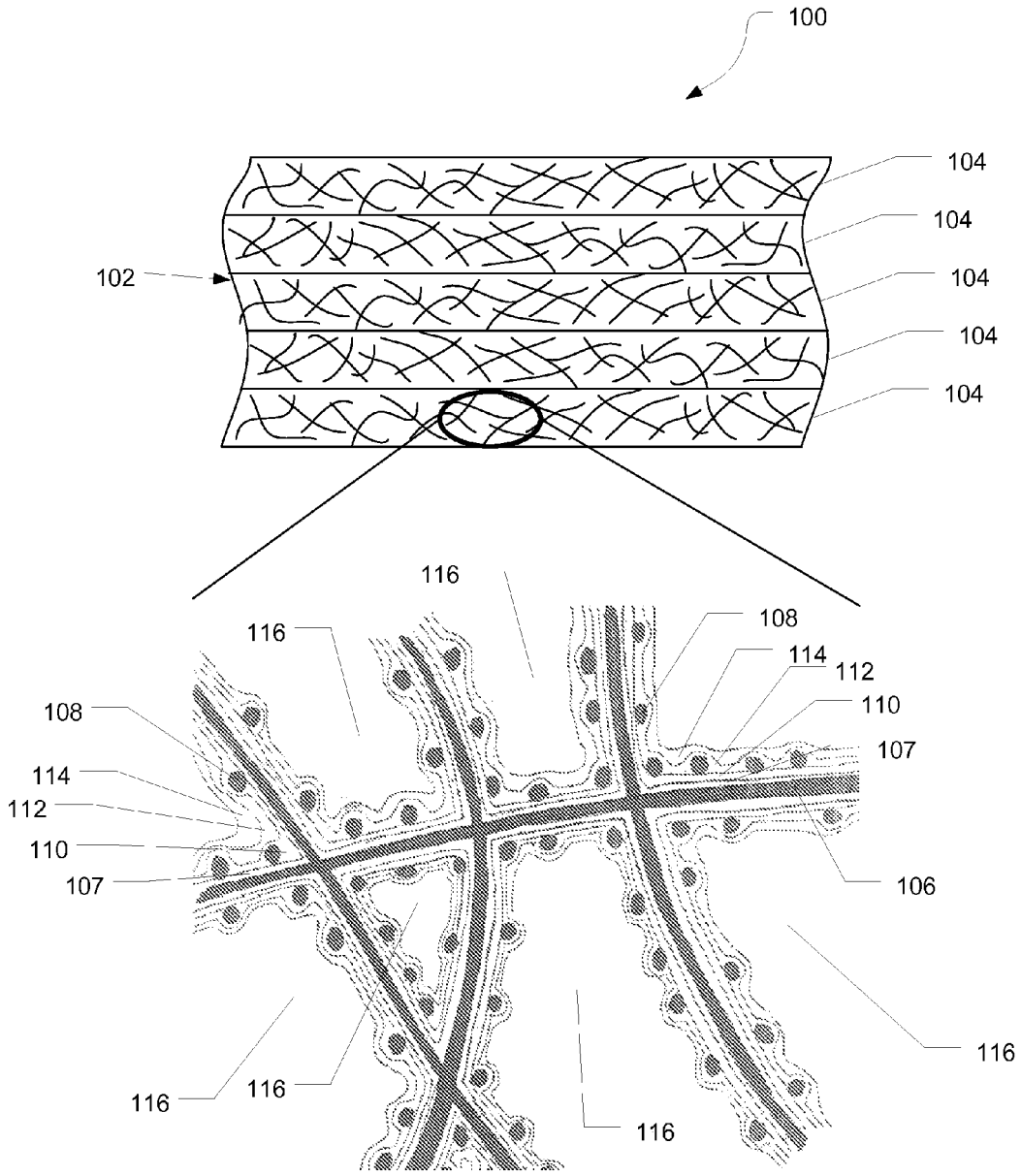
FIG. 1 includes an illustration of an exemplary abrasive article.

FIG. 1 illustrates an abrasive article 100. The abrasive article 100 includes a support 102 including a plurality of nonwoven layers 104. In an embodiment, the support 102 can include about 2 to about 50 nonwoven layers 104. Further, each nonwoven layer 104 can include a plurality of fibers 106. The fibers 106 can be bonded to each other by a polymeric binder, such as one derived from a latex. The fibers 106 can include natural fibers, inorganic fibers, such as fiberglass, synthetic fibers, such as polyester fibers, polyamide fibers, or other suitable synthetic fibers, or any combination thereof. In a preferred embodiment, the fibers 106 are polyamide fibers.

The abrasive article 100 can further include abrasive particles 108 and polymeric binder layers 110, 112, and 114. Further, the abrasive article 100 can have an open structure defined by a plurality of voids 116. Optionally, the plurality of fibers 106 can be bound by a further binder 107 disposed between the fibers and the polymeric binder layers 110, 112, and 114.

The abrasive particles can have a Mohs hardness of at least about 8.0, such as at least about 8.5, even at least about 9.0. In particular, the abrasive particles 108 can include superabrasive particles, such as diamond, cubic boron nitride, boron carbide, silicon carbide, or any combination thereof. The abrasive particles can have a size of between about 10 microns and about 1000 microns, such as between about 50 microns and about 500 microns, particularly between about 100 microns and about 200 microns.

Polymeric binder layer 110 can include a curable polymeric binder. The curable polymeric binder can include a polyurethane resin, a phenoxy resin, polyester resin, or any combination thereof. Further, the curable polymeric binder can include a blocked resin. Polymeric binder layer 110 can be a strong and flexible polymeric binder. Polymeric binder layer 110 can hold the support together during abrading while allowing the support to be flexible enough to conform to the shape of the work piece. In a particular embodiment, polymeric binder material of polymeric binder layer 110 can be located between the fibers 106 and the abrasive particles 108.

Polymeric binder layer 112 can include another polymeric binder, such as a phenolic resin, an epoxy resin, a formaldehyde-urea resin, or any combination thereof. Polymeric binder layer 112 can include a binder that bonds without significant curing. Polymeric binder layer 112 can be used bond the abrasive particles 108 to the support 102 and to permit additionally processing of the abrasive article 100 before thermal curing to set the additional polymer layers 110 and 114. In an embodiment, the polymeric binder material of polymeric binder layer 112 can overlie the abrasive particles 108.

Polymeric binder layer 114 can include another polymeric binder. In an embodiment, the polymeric binder of polymeric binder layer 114 can be substantially similar to the curable polymeric binder of polymeric binder layer 110. Polymer binder layer 114 can provide further strength to the abrasive article without significantly diminishing the flexibility and conformability of the abrasive article. Additionally, polymeric binder layer 114 can strongly bond the abrasive particles to the support. In an embodiment, polymeric binder material of polymeric binder layer 114 can overlie the abrasive particles 108.

In an embodiment, the polymeric binder layers 110, 112, and 114 can be formed from binder formulations that can further include components such as dispersed filler, solvents, plasticizers, chain transfer agents, catalysts, stabilizers, dispersants, curing agents, reaction mediators, or agents for influencing the fluidity of the dispersion. In addition to the above constituents, other components can also be added to the binder formulation, including, for example, anti-static agents, such as graphite, carbon black, and the like; suspending agents, such as fumed silica; anti-loading agents, such as metal stearate, including zinc, calcium, or magnesium stearate; lubricants such as wax; wetting agents; dyes; fillers; viscosity modifiers; defoamers; or any combination thereof.

In an embodiment, the abrasive article 100 can have an open structure. The open structure can include voids 116 located between the fibers 106. The open structure can be at least about 25% open volume, such as at least about 40% open volume, such as at least about 55% open volume. Additionally, the open structure can be not greater than about 99% open volume, such as not greater than about 95% open volume, even not greater than about 90% open volume.

Figure 2:
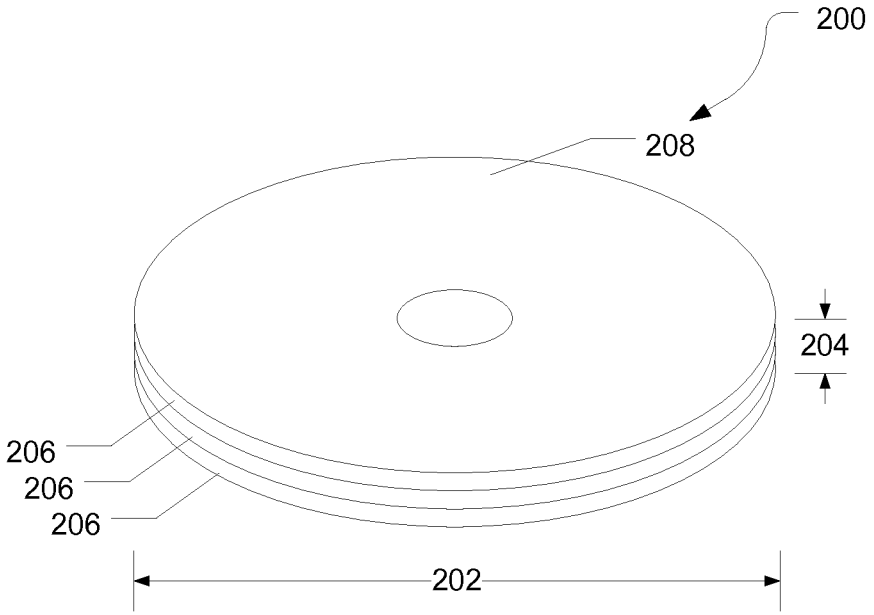
FIG. 2 includes a prospective view of an exemplary abrasive article.

In an embodiment, the abrasive article can be in the form of a wheel, disk, belt, slab, stick, or the like. FIG. 2 illustrated an abrasive article 200 in the form of a wheel. The wheel can have a diameter 202 of about 250 mm to about 510 mm. In another embodiment, the wheel can have a width 204 of about 3 mm to about 105 mm, such as about 6 mm to about 80 mm, even about 12 mm to about 50 mm. The nonwoven layers 206 can be arranged parallel to the major surface 208 of the abrasive article 200.

In an embodiment, the abrasive article can have a hardness of 20 $kg_f$/25% compression to 90 $kg_f$/25% compression, such as 30 $kg_f$/25% compression to 80 $kg_f$/25% compression, even 40 $kg_f$/25% compression to 70 $kg_f$/25% compression as measured by applying a force with a 25.4 mm semi-spherical probe to compress the abrasive article by 25% along the thickness direction. In a particular embodiment, the hardness can be 50 to 60 $kg_f$/25% compression.

Turning to the method of forming the abrasive article, a support comprising a plurality of nonwoven layers can be provided. For example, a plurality of fibers can be deposited randomly and bound together with a polymeric binder, such as an acrylic or polyurethane latex. In an example, between 74 $g/m^2$ and 150 $g/m^2$ of fibers can be used, along with 14 $g/m^2$ to 75 $g/m^2$ of latex. In an embodiment, the nonwoven layer can have a thickness of at least about 0.5 mm, such as at least about 1.25 mm, even at least about 2.5 mm. Further, the nonwoven layer can have a thickness of not greater than about 12.5 mm, even not greater than about 25 mm.

A first coating a first polymeric binder can be applied to the nonwoven layer. The first polymeric binder can be a curable binder, such as a polyurethane resin, a phenoxy resin, polyester resin, or any combination thereof. The binder can be blocked to substantially prevent curing without the application of heat. The first coating can be applied by immersing the support into the first polymeric binder. After immersion, the support can be squeezed to remove excess binder and obtain a desired weight of the first coating. For example, the weight of the first coating can be from 74 $g/m^2$ to 150 $g/m^2$.

Abrasive particles can be applied to the support, such as by dropping the abrasive particles onto the support or projecting the abrasive particles into the nonwoven layer. For example, from 515 $g/m^2$ to 1040 $g/m^2$ can be dropped onto the nonwoven layer, with half dropped on each side to distribute the abrasive grains throughout the layer. A layer of a second polymeric binder can be applied overlying the abrasive particles, such as by spraying, and the second polymeric binder can be dried. The second layer can be applied to a weight of 74 $g/m^2$ to 150 $g/m^2$. The second polymeric binder can serve to retain the abrasive particles during subsequent processing. In an alternative embodiment, the abrasive particles and the first polymeric binder can be combined in a slurry and applied together and the second polymeric binder may be absent.

A second coating of the first polymeric binder can be applied. The second coating can be applied by immersing the support into the first polymeric binder. After immersion, the support can be squeezed to remove excess binder and obtain a desired weight of the second coating. For example, the weight of the second coating of the first polymeric binder can be from 295 $g/m^2$ to 600 $g/m^2$.

A plurality of the coated nonwoven layers, such as between about 2 and about 50 layers, can be stacked to form the support. In an embodiment, between about 3 to about 40 layers can be stacked, such as between about 4 to about 30 layers, even 5 to about 20 layers. The stacked layers can be compressed to a desired density and heat applied to cure the first polymeric binder. For example, the article can be compressed to at least 10%, such as at least 20%, at least 25%, or even at least 30% of its original height. In a particular embodiment, the abrasive article can include from 9 to 15 layers per inch (25.4 mm). The abrasive article can be cut to the desired shape, such as a wheel. The wheel can have a diameter of about 25 mm to about 510 mm and a width of about 3 mm to about 105 mm.

Figure 3:
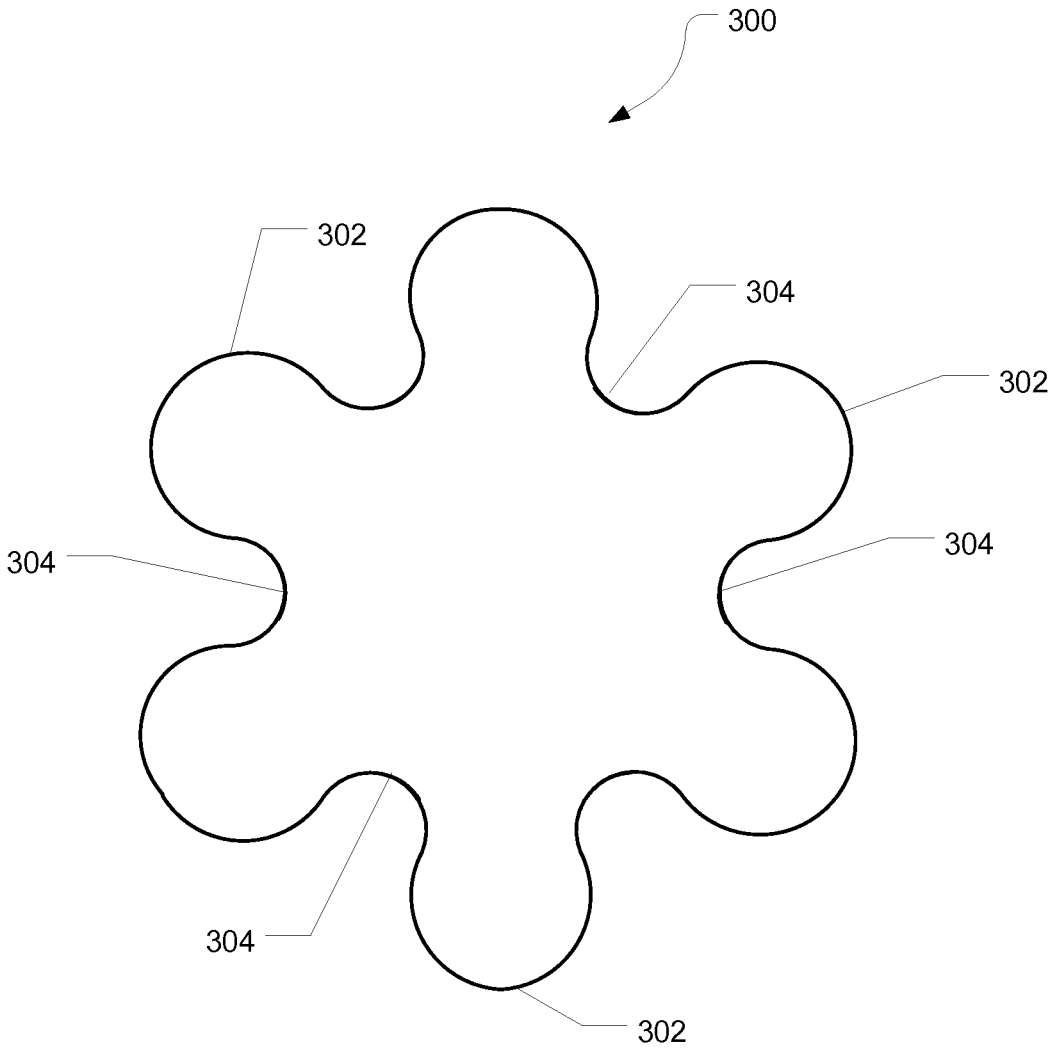
FIG. 3 includes an illustration of an exemplary work piece.

In an embodiment, the abrasive article can be used to prepare a work piece. In particular, the work piece can have a complicated contour. FIG. 3 illustrates a cross section of a work piece 300. Work piece 300 can have a plurality of lobes 302 and groves 304 located between the lobes 302. Additionally, work piece 300 can be spiraled, so that the shape of the cross section is rotated either to the right or to the left along the length of the work piece. The abrasive article can be sufficiently deformable to adapt to the contour of the groves 304.

In an embodiment, a method of preparing the work piece can include applying a thermal spray coating to the work piece. The thermal spray coating can be a plasma spray coating, a high velocity oxygen fuel (HVOF) thermal spray coating, or the like. The thermal spray coating can include a metal, such as chromium, nickel, cobalt, or the like, a carbide, such as tungsten carbide or chrome carbide, or any combination thereof. In a particular embodiment, the thermal spray coating can include tungsten.

The thermal spray coating can be polished using the abrasive article. In an embodiment, the thermal spray coating can be polished until a surface finish having a roughness (Ra) of not greater than about 0.24 microns, such as 0.16 microns, even 0.08 microns, is achieved.

Generally, conventional abrasives are not adequate for polishing thermal spray coatings. Additionally, it can be difficult to reach contoured surfaces with conventional abrasives. Applicants discovered abrasive articles according to the present disclosure have the right balance of strength, flexibility, and grind to provide a desired finish for articles having a complex shape profile and a thermal spray coating.

EXAMPLES

Sample 1 is prepared from a non-woven slab produced from a 60 denier nylon fiber and an acrylic binder. 108 g/m$^2$ of fiber is deposited randomly and bonded together using 50 g/m$^2$ of acrylic binder. A pre-size coating is applied by impregnating the slab with 89 g/m$^2$ pre-size mix in a horizontal coater. The pre-size mix contains 22 wt % methyl isobutyl ketone, 6 wt % methylenedianiline, 7 wt % methyl ethyl ketone, 9 wt % calcium stearate, 9 wt % talc, 42 wt % polyurethane resin, and 5 wt % phenoxy resin. Additionally, 681 g/m$^2$ of abrasive grain is applied by dropping 341 g/m$^2$ on each side of the slab. A phenolic resin mix (43 wt % water and 57 wt % phenolic resin) is sprayed at 56 g/m$^2$ per side. The slabs are dried for 30 minutes at 300° F. The slabs are impregnated with 444 g/m$^2$ of a size mix containing 11.4 wt % methyl isobutyl ketone, 7 wt % methylenedianiline, 7 wt % methyl ethyl ketone, 10 wt % calcium stearate, 10 wt % talc, 49 wt % polyurethane resin, and 5.5 wt % phenoxy resin. 3 slabs are stacked and compressed between steel plates to a final thickness of 6.35 mm and cured for 4 hours at 260° F. and 14 hours at 210° F. The resulting abrasive article is cut to the desired shape.

Sample 2 is prepared as Sample 1, except a blend of 25% diamond and 75% agglomerate silicon carbide is used as the abrasive.

Sample 3 is prepared as Sample 1, except a blend of 12.5% diamond and 87.5% agglomerate silicon carbide is used as the abrasive.

Sample 4 is prepared as Sample 1, except aluminum oxide is used as the abrasive.

Example 1

Performance

Samples are tested to determine cut rate, wheel wear, and G-Ratio. The G-Ratio is the ratio of the amount of material removed to the amount of wheel wear. Sample wheels having a thickness of 6.35 mm are cut to 76 mm outer diameter and 6.35 mm inner diameter. A metal plate (94% tungsten carbide/6% cobalt, commercially available from Philadelphia Carbide Co.) is subjected to grinding by the sample discs. Grinding is performed with the sample discs held perpendicular to the surface so that the full thickness of the sample disc is in contact with the metal plate and is positioned to avoid edge grinding. A 0.9 kg load is used to force the disc against the metal plate. The plate is ground for five 1 minute cycles with a 15 second cooling period between each cycle. The wheel is rotating at 9,000 rpm. The cut rate is determined from the difference in the weight of the plate before and after grinding. The wheel wear is determined from the difference in the weight of the wheel before and after grinding.

TABLE 1

| | Material Removed (mg) | Wheel Wear (mg) | G-Ratio |
|---|---|---|---|
| Sample 1 | 1,600 | 193 | 8.3 |
| Sample 2 | 367 | 160 | 2.3 |
| Sample 3 | 197 | 130 | 1.5 |
| Sample 4 | 23 | 87 | 0.3 |

Example 2

Wheel Hardness

Wheel Hardness is determined by measuring the force required to compress the wheel by 25% along the thickness direction. Sample wheels having a thickness of 6.35 mm are cut to 430 mm outer diameter and 76 mm inner diameter. The force is measured using a Thwing Albert Tensile Tester using a 25.4 mm semi-spherical probe. The results are shown in Table 2.

TABLE 2

| | Hardness (kg/25% compression) |
|---|---|
| Sample 1 | 45.3 |
| Sample 2 | 54.8 |
| Sample 3 | 72.1 |
| Sample 4 | 63.4 |

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article comprising:

a support comprising a plurality of nonwoven layers, each nonwoven layer comprising a plurality of fibers;

a first polymeric binder disposed on the fibers, wherein the first polymeric binder includes a polyurethane resin and a phenoxy resin;

abrasive particles having a Mohs hardness of at least about 8.0 disposed on the first polymeric binder;

a second polymeric binder disposed on the abrasive particles and the first polymeric binder, wherein the second polymeric binder comprises a phenolic resin; and a third polymeric binder disposed on the second polymeric binder, wherein the third polymeric binder includes a polyurethane resin and a phenoxy resin.

2. The abrasive article of claim 1, wherein the space between the abrasive particles and the support is substantially free of the second polymeric binder.

3. The abrasive article of claim 1, wherein the abrasive article is in the form of a wheel.

4. The abrasive article of claim 1, wherein the plurality of nonwoven layers includes about 2 to about 50 nonwoven layers.

5. The abrasive article of claim 1, wherein the fibers are bonded by a further polymeric binder disposed on the fibers between the fibers and the first polymeric binder, wherein the further polymeric binder comprises an acrylic resin.

6. The abrasive article of claim 1, wherein a nonwoven layer of the plurality of nonwoven layers has a thickness of at least 0.5 mm.

7. The abrasive article of claim 1, wherein abrasive article has an open structure.

8. The abrasive article of claim 7, wherein the abrasive article has at least 25% open volume.

9. The abrasive article of claim 1, wherein the abrasive article has a hardness in a range of 20 kgf/25% compression to 90 kgf/25% compression.

10. An abrasive article comprising:

a support comprising about 2 to about 50 nonwoven layers, wherein each nonwoven layer comprises a plurality of fibers;

a first polymeric binder disposed on the fibers, wherein the first polymeric binder includes a polyurethane resin and a phenoxy resin;

a plurality of superabrasive particles disposed on the first polymeric binder;

a second polymeric binder disposed on the first polymeric binder and the plurality of superabrasive particles, wherein the second polymeric binder comprises a phenolic resin; and a third polymeric binder disposed on the second polymeric binder, wherein polymeric binder includes a polyurethane resin and a phenoxy resin wherein the plurality of fibers is bonded together by a further polymeric binder disposed on the fibers between the fibers and the first polymeric binder, wherein the further polymeric binder comprises an acrylic latex or a polyurethane latex resin, wherein the abrasive article has a hardness in a range of 20 kgf/25% compression to 90 kgf/25% compression, and wherein the abrasive article is in the form of a wheel and has an open structure.

11. A method of forming an abrasive article, comprising:

providing a support comprising a plurality of nonwoven layers, each nonwoven layer comprising a plurality of fibers;

applying a first coating of a first polymeric binder to the fibers wherein the first polymeric binder includes a polyurethane resin and a phenoxy resin;

applying abrasive particles to the coating of first polymeric binder;

applying a layer of a second polymeric binder over the abrasive particles and the coating of first polymeric binder, wherein the second polymer layer is a phenolic resin;

applying a layer of a third polymeric binder over the second polymeric binder, wherein the third polymeric binder includes a polyurethane resin and a phenoxy resin;

compressing the support; and applying heat to cure the polymeric binders.

12. The method of claim 11, wherein applying the first coating of the first polymeric binder includes dipping the support into the first polymeric binder and squeezing the support to remove a portion of the first polymeric binder from the support.

13. The method of claim 11, further comprising applying a second coating of the first polymeric binder on the layer of the second polymeric binder.

14. The method of claim 11, further comprising cutting the abrasive article into the form of a wheel.

15. The method of claim 11, wherein providing the support includes:

forming a plurality of fibers into a plurality of nonwoven layers; binding the plurality of fibers together with a further polymeric binder; and stacking the plurality of nonwoven layers to form the support.

* * * * *